US005738232A

United States Patent [19]

Roberts et al.

[11] Patent Number: 5,738,232

[45] Date of Patent: Apr. 14, 1998

[54] CLUTCH ADAPTER TO PREVENT OVER-TIGHTENING AN END CAP TO A FLUID RESERVOIR

[75] Inventors: Anthony V. Roberts, Rolling Hills Estates; William R. Reece, Irvine, both of Calif.

[73] Assignee: The CDM Company, Inc., Newport Beach, Calif.

[21] Appl. No.: 583,333

[22] Filed: Jan. 5, 1996

[51] Int. Cl.[6] ..... B67D 3/00

[52] U.S. Cl. ..... 215/228; 215/321; 215/387; 215/44; 215/12.1; 222/568; 222/562; 222/78; 446/74; 239/211; 220/739

[58] Field of Search ..... 446/71, 73, 74, 446/267; 222/568, 562, 531, 519, 545, 78; 239/211; 215/11.1, 11.6, 12.1, 44, 217, 218, 219, 220, 223, 228, 274, 276, 277, 303, 316, 321, 329, 330, 331, 334, 387; 220/435–440, 288, 255, 256, 376, 726, 727, 739, 903, DIG. 13; 206/217, 524.2, 822

[56] References Cited

U.S. PATENT DOCUMENTS

| | | | |
|---|---|---|---|
| 3,178,060 | 4/1965 | Bossack | 222/78 |
| 3,613,761 | 10/1971 | Moody | 215/11.6 X |
| 3,669,294 | 6/1972 | Petronelli et al. | 215/220 |
| 3,718,360 | 2/1973 | Knutzen | 215/11.6 X |
| 3,822,805 | 7/1974 | Marchant | 215/219 |
| 3,888,375 | 6/1975 | Gerk | 215/219 |
| 3,915,326 | 10/1975 | Hrubesky | 215/219 |
| 4,768,664 | 9/1988 | Zimmerman | 215/12.1 |
| 5,044,509 | 9/1991 | Petrosky et al. | 215/11.6 X |
| 5,480,044 | 1/1996 | Nosser | 215/228 |
| 5,489,050 | 2/1996 | Finkiewicz et al. | 222/78 X |

FOREIGN PATENT DOCUMENTS

| | | | |
|---|---|---|---|
| 965042 | 3/1975 | Canada | 215/220 |

*Primary Examiner*—Allan N. Shoap
*Assistant Examiner*—Nathan Newhouse
*Attorney, Agent, or Firm*—Morland C. Fischer

[57] ABSTRACT

A hollow, cylindrical clutch adapter that surrounds a screw-on end cap and prevents the transfer of excessive torquing forces to the end cap so as to avoid over-tightening the end cap to a threaded neck of a fluid reservoir, such as that common to a squeeze bottle. The squeeze bottle includes an outer body that surrounds the fluid reservoir and a hollow head that surrounds the clutch adapter and is rotatable relative to the outer body. The clutch adapter includes a series of parallel aligned splines or teeth projecting radially inward thereof so as to be respectively interspersed between the usual ridges that are molded into the end cap, whereby to insure that a rotational force applied to the clutch adapter will be transmitted to the end cap. The hollow head is rotated to apply a corresponding rotational force to the end cap via the clutch adapter located therebetween. Once the end cap has been sufficiently tightened against the neck of the fluid reservoir, any further rotation of the head will cause the clutch adapter affixed thereto to slip and rotate around the end cap, such that excessive torquing forces that are applied to the head will be dissipated by the clutch adapter.

10 Claims, 4 Drawing Sheets

CLUTCH ADAPTER TO PREVENT OVER-TIGHTENING AN END CAP TO A FLUID RESERVOIR

BACKGROUND OF THE INVENTION

1. Field of the Invention

This invention relates to a clutch adapter that surrounds a screw-on end cap and prevents the transfer of excessive torquing forces to the end cap so as to avoid over-tightening the end cap to a threaded neck of a fluid reservoir, such as that common to a squeeze bottle, or the like.

2. Background Art

Fluid reservoirs that carry liquids suitable for human consumption are typically characterized by a hollow flexible fluid vessel in which the liquid is stored and an upstanding neck that communicates with the fluid vessel so that the liquid can be removed therefrom under pressure when the vessel is squeezed. The top of the neck is often screw threaded so that a correspondingly screw threaded end cap can be closed thereagainst in order to block access to the contents of the fluid vessel and thereby avoid an accidental spilling or evaporation thereof.

Sometimes, however, an excessive torquing force is applied when rotating the end cap into engagement with the neck of the fluid vessel, such that the end cap becomes over-tightened. Consequently, the screw threads of the end cap and/or the neck of the fluid vessel may be damaged to prevent the repeated use of the fluid reservoir or affect the reliability of the closure made by tightening the end cap against the neck. In other cases, an over-tightening of the end cap may result in small children being unable to remove the end cap from the neck so as to gain access to the contents of the fluid vessel, particularly when the fluid vessel is a water bottle.

Therefore, it would be desirable to have available a means for reliably closing an end cap against the neck of a fluid vessel while limiting the torquing (i.e. rotational) forces that are applied to the end cap so as to avoid over-tightening the end cap and possibly stripping the threads thereof.

SUMMARY OF THE INVENTION

Disclosed herein is a clutch adapter that surrounds a screw-on end cap so as to prevent the transfer of excessive torquing forces to the end cap and thereby avoid an over-tightening of the end cap to a threaded end of a fluid reservoir, such as that common to a squeeze bottle in which water or similar consumable liquids are stored and carried. The clutch adapter has a hollow, cylindrical body with an annular ledge at the interior thereof and a series of slots extending longitudinally above the annular ledge. The end cap is pressed through the top of the cylindrical clutch adapter to be seated upon the annular ledge. The longitudinally extending slots permit the clutch adapter to flex so as to surround the end cap in close frictional engagement therewith. The clutch adapter also has a series of parallel aligned splines or teeth formed at the interior thereof. The teeth are located so as to be in facing alignment with and interspersed between the usual ridges that are molded into the end cap in order to insure that a rotational force applied to the clutch adapter will be transmitted to the end cap.

According to the preferred embodiment, the fluid reservoir is surrounded by an outer body. The clutch adapter is surrounded by and affixed to a hollow head, such that a rotation of the head is imparted to the clutch adapter therewithin. The head and body may be molded into an aesthetically pleasing shape, such as that resembling a dinosaur. In operation, the head is rotated relative to the outer body in order to correspondingly cause the end cap to be rotated via the clutch adapter into mating engagement with the threaded end of the neck of the fluid reservoir. Once the end cap has been sufficiently tightened against the neck so as to close the fluid reservoir, any further rotation of the head will cause the clutch adapter to slip and rotate around the end cap. More particularly, an excessive rotational torquing force that is applied to the head will be dissipated by the rotation of the clutch adapter around the end cap so as to advantageously avoid transferring such rotational torquing force to the already tightened end cap.

DETAILED DESCRIPTION

Figure 1:
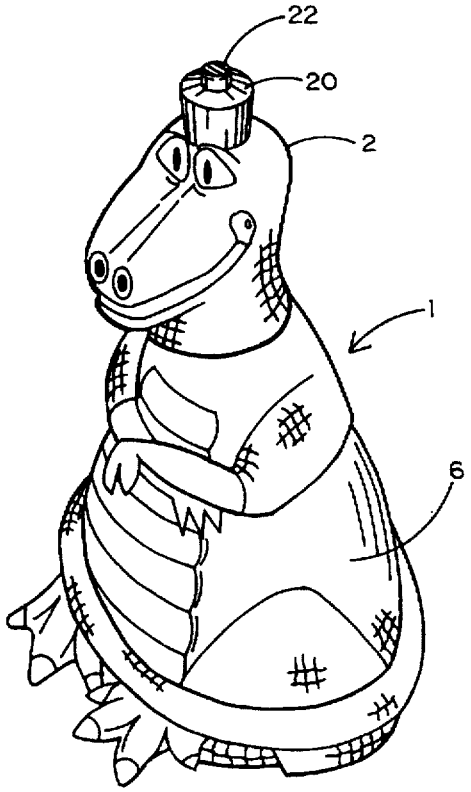
FIG. 1 is a perspective view of a squeeze bottle of the type in which the clutch adapter of this invention may be used.
Figure 2:
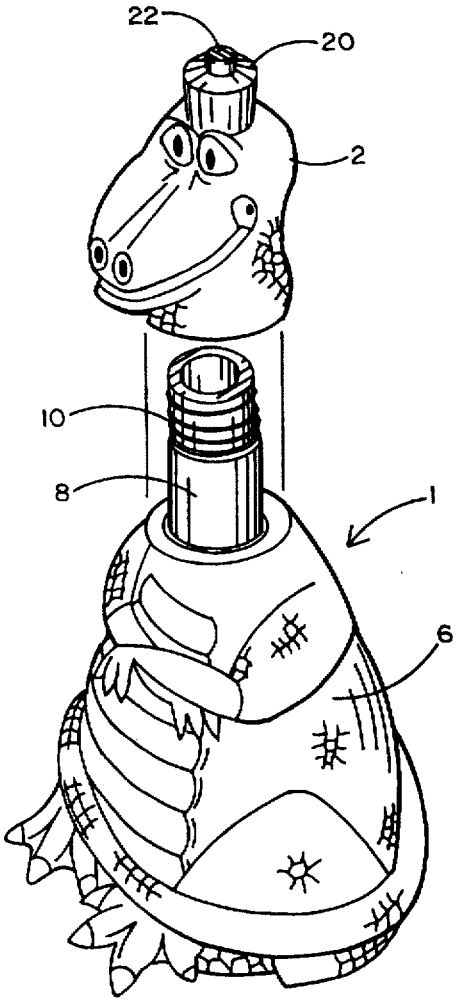
FIG. 2 shows the squeeze bottle of FIG. 1 with a rotatable head thereof being removed from an outer body.
Figure 3:
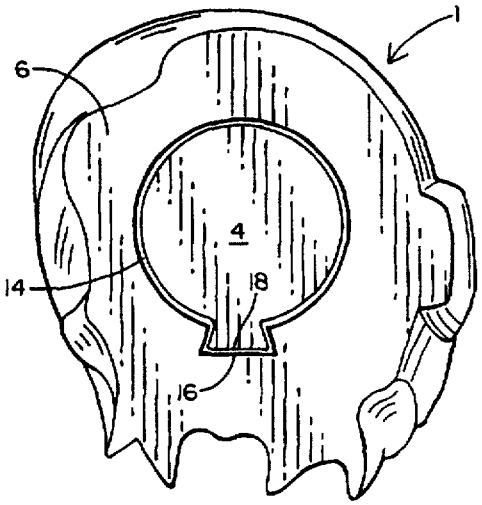
FIG. 3 shows the bottom of the squeeze bottle with a hollow fluid vessel located inside the outer body.

The clutch adapter 30 which forms the present invention is initially described while referring concurrently to FIGS. 1–4 of the drawings, where there is shown a squeeze bottle 1 having a hollow, removable head 2 and a flexible fluid vessel 4 (best shown in FIG. 4) that is surrounded by a hollow outer body 6. In the assembled squeeze bottle relationship, and as will be described in greater detail hereinafter, the head 2 is located atop and rotatable relative to the outer body 6. The fluid vessel 4 of squeeze bottle 1 is manufactured (e.g. blow molded) from a relatively soft plastic (e.g. polyethylene) so as to be capable of being force fit within the hollow outer body 6 in the manner to be described below. Fluid vessel 4 of squeeze bottle 1 is of the type that would typically be filled with a fluid to be consumed by the user, such as water, vinegar or ketchup, to name but a few. The fluid vessel 4 includes an elongated neck 8 having a screw threaded end 10. A correspondingly screw threaded end cap 12 (best shown in FIGS. 6 and 7) is removably coupled to the neck 8 at the screw threaded end 10 thereof in order to close the fluid vessel 4 of squeeze bottle 1.

Figure 4:
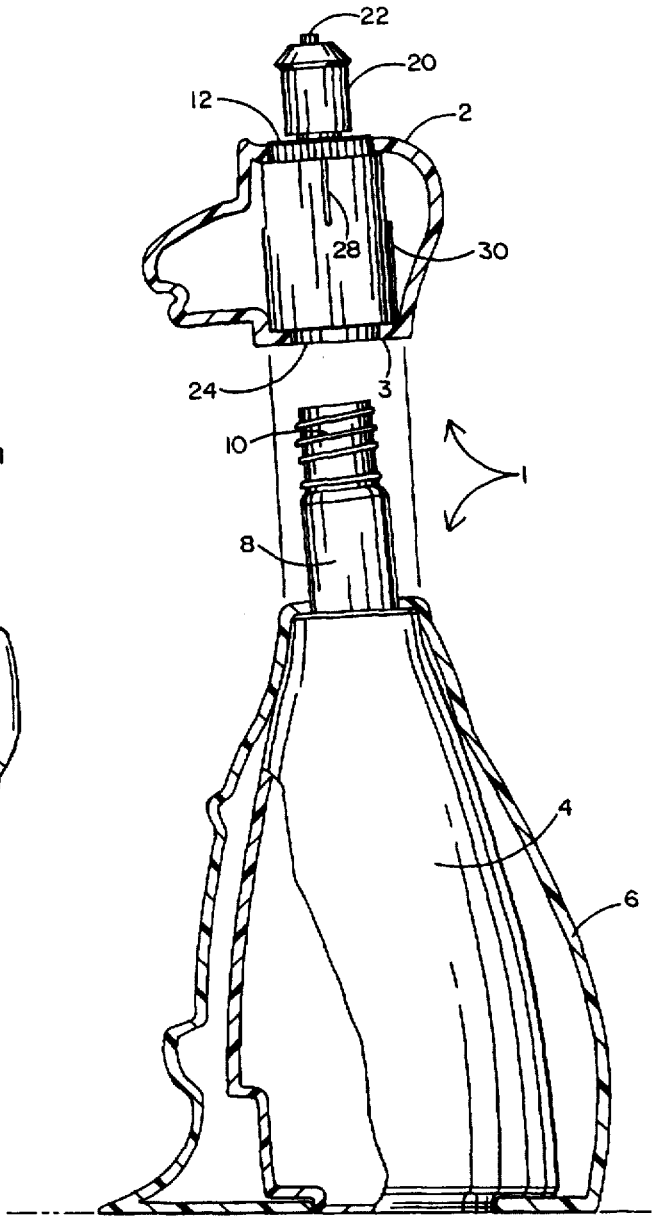
FIG. 4 is a cross-section of the squeeze bottle of FIG. 2 showing the fluid vessel surrounded by the outer body and the clutch adapter surrounded by the removable head.
Figure 7:
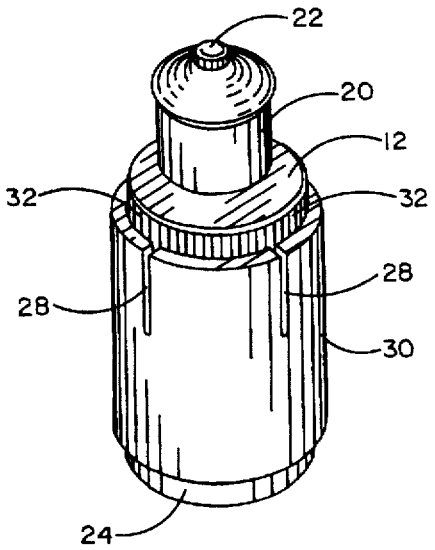
FIG. 7 shows the clutch adapter of FIG. 6 surrounding the end cap in close frictional engagement therewith.
Figure 6:
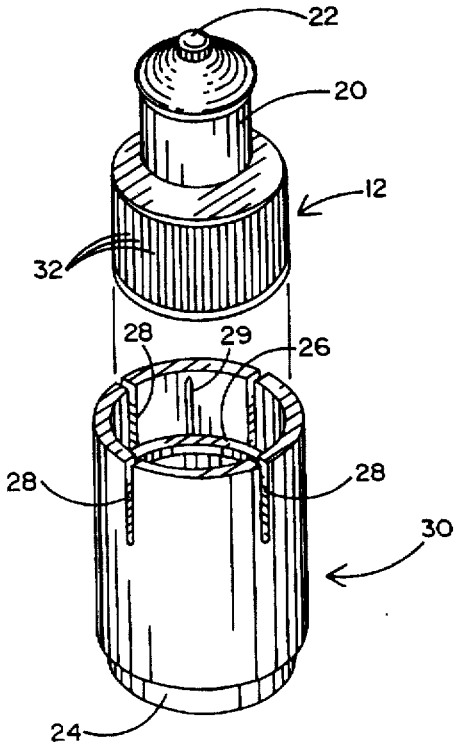
FIG. 6 is an exploded view of the clutch adapter and an end cap that is to be closed against the fluid vessel of the squeeze bottle when the clutch adapter is rotated.
Figure 5:
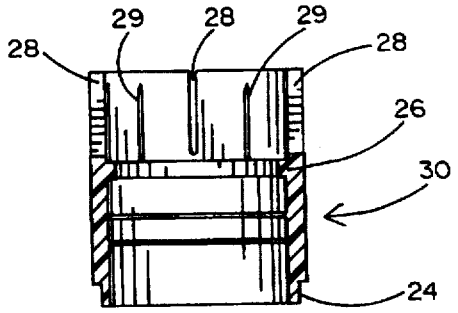
FIG. 5 is a cross-section of the clutch adapter which forms the present invention.
Figure 9:
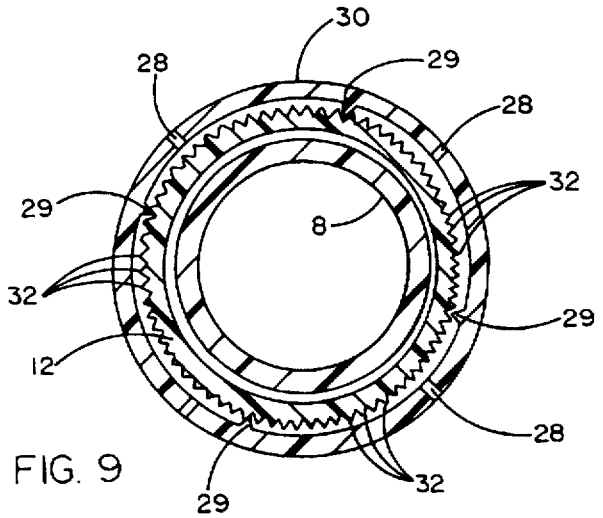
FIG. 9 is a cross-section taken along lines 9—9 of FIG. 8.

As will be disclosed when referring to FIGS. 5–7, the clutch adapter 30 surrounds the end cap 12 in coaxial alignment therewith. What is more, and as is best shown in FIG. 4, the clutch adapter 30 is fixedly secured (e.g. glued) to and surrounded by the hollow head 2 of squeeze bottle 1 so as to be removable therewith when the head 2 of squeeze bottle 1 is rotated relative to and separated from the outer body 6, whereby to remove end cap 12 from threaded end 10 and thereby permit the fluid vessel 4 to be opened and filled with fluid via the neck 8. That is to say, when the end cap 12 is uncoupled (i.e. unscrewed) from the threaded end 10 of neck 8 to permit access to the fluid vessel 4, the clutch adapter 30 which surrounds the end cap 12 and the hollow head 2 which is affixed to clutch adapter 30 are all removed from the neck 8 as a single unit.

The hollow head 2 and outer body 6 of squeeze bottle 1 are manufactured (e.g. rotocast) from a pliable plastic material (e.g. PVC) so that a compressive force applied to outer body 6 will be transferred to the fluid vessel 4 therewithin. Moreover, the outer body 6 is adapted to flex so that the fluid vessel 4 can be pushed upwardly into body 6 with the neck 8 of vessel 4 projecting outwardly through an opening in the top of the outer body 6 for attachment to end cap 12. To accomplish the foregoing, the hollow outer body 6 has a hole (designated 14 in FIG. 3) formed in the bottom thereof to receive the soft fluid vessel 4 therethrough, whereby the outer body 6 will accommodate and surround the fluid vessel 4 located therewithin.

The hole 14 at the bottom of the outer body 6 contains a keyway 16 that is sized to receive a corresponding radial projection or key 18 that extends outwardly from the fluid vessel 4 so that in the assembled relationship of squeeze bottle 1, with the outer body 6 surrounding the fluid vessel 4, the receipt of the key 18 in the keyway 16 will prevent the rotation of the vessel 4 relative to the body 6.

The hollow head 2 and outer body 6 of squeeze bottle 1 should be soft enough to accommodate the clutch adapter 30 and the fluid vessel 4, respectively, therewithin and avoid damage if dropped or subjected to an impact force made by a collision with a hard surface. The head 2 and outer body 6 should also be hard enough so that they may be molded and then painted to assume an aesthetically pleasing shape. In this regard, while the head 2 and outer body 6 of squeeze bottle 1 are illustrated as having the appearance of a toy (e.g. a dinosaur), it is to be understood that this shape is for the purpose of example only and is not to be considered a limitation of the present invention. Therefore, the head 2 and outer body 6 may be molded and painted so that squeeze bottle 1 can assume other shapes having an appearance that would be pleasing to both adults and/or children. In any event, it may be appreciated that by having the outer body 6 fit around the polyethylene fluid vessel 4, fluids that are to be carried in the vessel 4 for eventual human consumption need not come in direct contact with the PVC from which the outer body 6 is manufactured so as to comply with certain government regulations concerning the storage of edible liquids and the like.

Figure 8:
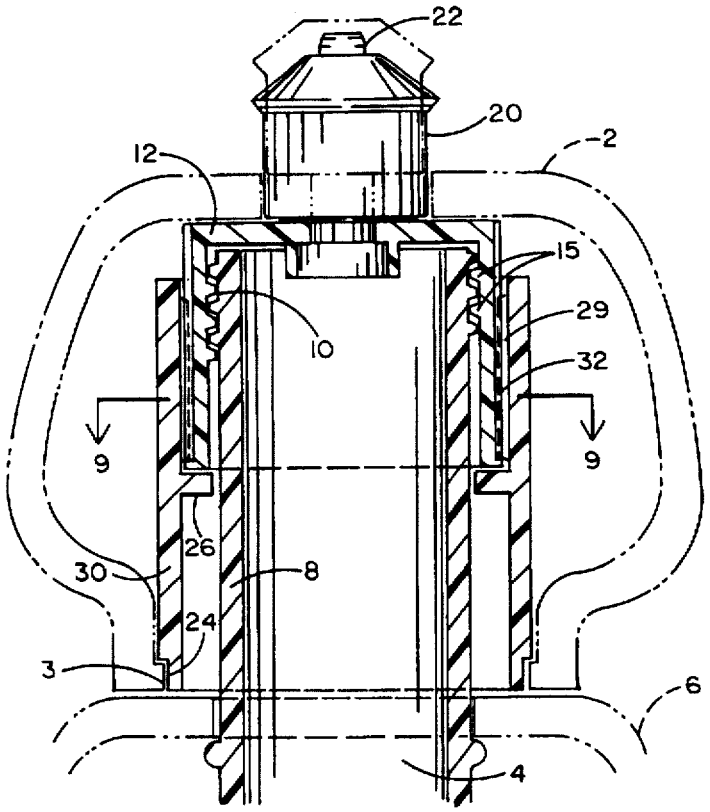
FIG. 8 is a cross-section of the clutch adapter surrounding the end cap and the end cap closed against the fluid vessel.

As indicated above, the hollow head 2 of squeeze bottle 1 is fixedly secured around the clutch adapter 30 that surrounds the end cap 12 and is removably coupled therewith at the threaded end 10 of the neck 8 to close the fluid vessel 4. To this end, the end cap 12 has the usual pop-up sipper spout 20 that projects through an opening formed in the top of the head 2. The sipper spout 20 lies in fluid communication with end cap 12 and is adapted to slide forwardly over a sipper plug 22 (shown in phantom lines in FIG. 8) to selectively open a fluid path from the fluid vessel 4 of squeeze bottle 1 to the sipper spout 20 via the neck 8, the threaded end 10 and the end cap 12, whereby the fluid contents of the fluid vessel 4 may be removed under pressure by the user. Sliding the sipper spout 20 rearwardly over the sipper plug 22 closes the aforementioned fluid path from the fluid vessel 4 and prevents any further removal of fluid from vessel 4.

Details of the clutch adapter 30 and the relationship of the end cap 12 to clutch adapter 30 are now described while referring to FIGS. 5–7 of the drawings. The clutch adapter 30 which forms the present improvement includes a hollow, cylindrical body that is molded from a hard (e.g. ABS) plastic. A peripheral groove 24 extends around the bottom of clutch adapter 30 in which to receive a suitable adhesive so as to affix the clutch adapter to a correspondingly sized peripheral lip (designated by reference numeral 3 in FIGS. 3 and 8) at the bottom of the hollow head 2 of squeeze bottle 1. An annular ledge 26 projects radially inward of the hollow clutch adapter 30 approximately midway along the length thereof to form a seat against which to receive the end cap 12 when end cap 12 is surrounded by clutch adapter 30 (best shown in FIG. 8). To facilitate the surrounding engagement of clutch adapter 30 to end cap 12, a series of longitudinal slots 28 are formed in and evenly spaced from one another around the clutch adapter 30 to permit clutch adapter 30 to flex slightly in order to accommodate the end cap 12 therewithin. A series of longitudinally extending splines or teeth 29 are evenly spaced from one another and project inwardly from clutch adapter 30 above the annular ledge 26. Each tooth 29 is located between a pair of the longitudinal slots 28.

The end cap 12 is conventional in construction and includes a set of internal screw threads (designated 15 in FIG. 8) and the previously mentioned sipper spout 20 that is slidable reciprocally over the sipper plug 22 to open or close a fluid path from the fluid vessel 4 surrounded by the outer body 6 of squeeze bottle 1. A series of spaced, parallel aligned axial ridges 32 are molded into the body of end cap 12 around the outer periphery thereof. In the assembled relationship of FIG. 7, the end cap 12 is press fit through the top of the hollow cylindrical clutch adapter 30 so as to be seated upon the annular ledge 26. The clutch adapter 30 may flex slightly between the longitudinal slots 28 so that clutch adapter 30 will surround the end cap 12 to form a close frictional engagement therewith. In this regard, and as an important detail of this invention, the longitudinally extending teeth 29 inside clutch adapter 30 are aligned in facing engagement with the series of axial ridges 32 outside the end cap 12.

The operation of the clutch adapter 30 of this invention for preventing an over-tightening of the end cap 12 when the end cap is closed against the threaded end 10 of the neck 8 of fluid vessel 4 is now disclosed while referring concurrently to FIGS. 5–9 of the drawings. As indicated above, and as best shown in FIG. 4, the clutch adapter 30 surrounds end cap 12 in frictional engagement therewith. In this case, the longitudinally extending teeth 29 of clutch adapter 30 are interspersed between respective pairs of the axial ridges 32 around the body of the end cap 12 to maximize the friction fit and insure that a rotation of the clutch adapter 30 will be imparted to the end cap 12. Moreover, since the hollow head 2 of squeeze bottle 1 is adhesively bonded to the clutch adapter 30 (at the intersection of the peripheral lip 3 of head 2 with the groove 24 of adapter 30), a rotation of the head 2 will be similarly imparted to the clutch adapter 30. In this same regard, it will be appreciated that since the head 2, clutch adapter 30 and end cap 14 of squeeze bottle 1 are coupled to and removed from the threaded end 10 of neck 8 as a unit, any rotational force applied by the user to the head 2 will be transferred to the end cap 12 via clutch adapter 30 so that the end cap 12 can be detached from or tightened against the neck 8 of the fluid vessel 4, whereby vessel 4 will be opened or closed.

More particularly, the user grasps and rotates the head 2 of squeeze bottle 1 relative to the outer body 6 in order to correspondingly rotate the end cap 12 into mating engagement with the screw threaded end 10 of neck 8. Once the end cap 12 has been sufficiently tightened against the neck 8 so as to establish a reliable closure of the fluid vessel 4, any over-tightening of the end cap 12 could damage the screw threads 15 of the cap 12 and/or the neck 8 or result in a closure of the fluid vessel 4 that cannot be easily opened by small children.

In accordance with the improvement provided by the present invention, when the head 2 of squeeze bottle 1 is rotated in a first (e.g. clockwise) direction after the fluid vessel 4 has been closed by the end cap 12, the clutch adapter 30 that surrounds the end cap 12 will slip relative to and rotate around the end cap 12 in the same direction in which the head 2 is being rotated. That is, sufficient torque will be generated to overcome the frictional engagement between the clutch adapter 30 and the end cap 12, whereby to cause the teeth 29 of clutch adapter 30 to rotate past the ridges 32 of the end cap 12. Therefore, any excessive rotational force applied to the head 2 of squeeze bottle 1 will be dissipated by the rotation of clutch adapter 30 around the end cap 12 to avoid transferring such excessive rotational force to the already tightened end cap 12. However, when the head 2 of squeeze bottle 1 is rotated in an opposite (e.g. counter-clockwise) direction, the frictional engagement between the clutch adapter 30 and the end cap 12 is reestablished, whereby the clutch adapter 30 will once again rotate in the same direction in which the head 2 is being rotated so as to now loosen the end cap 12 from the neck 8 of the fluid vessel 4.

In this same regard, while the clutch adapter 30 has been disclosed as preventing the over-tightening of the end cap 12 against the neck 8 of the fluid vessel 4, the clutch adapter 30 of this invention will also permit the position of the head 2 that surrounds the end cap 12 to be easily and accurately adjusted relative to the outer body 6 that surrounds fluid vessel 4 after the end cap 12 has been tightened to close fluid vessel 4. This feature is particularly advantageous when the head 2 and outer body 6 need to be rotated into alignment with one another to create a squeeze bottle 1 having the appearance of a toy (e.g. the dinosaur illustrated in FIGS. 1–4).

While a preferred embodiment of this invention has been shown and described, various modifications and changes may be made without departing from the true spirit and scope thereof. For example, while it has been disclosed above that the fluid vessel 4 is filled with a fluid that is suitable for human consumption, it is to be understood that the clutch adapter 30 of this invention also has application for preventing the over-tightening of an end cap to a fluid reservoir in which non-consumable fluids are stored. Similarly, it should be understood that this invention is not limited to squeeze bottles where a head (e.g. 2) is joined to an outer body (e.g. 6) when the end cap 12 is connected to the neck 8 of the fluid vessel 4. Accordingly, enclosures having shapes other than those resembling a head and a body may surround the end cap 12 and the fluid vessel 4 whether a toy figure or some other article is created in which to carry a fluid.

Having set forth the preferred embodiment, what is claimed is:

1. A combination, comprising:

a fluid reservoir having an open neck extending outwardly therefrom, said neck having a screw threaded end at which to receive a correspondingly screw threaded end cap so as to close said neck;

a hollow clutch adapter being a hollow body with two open ends, said clutch adapter surrounding the end cap, said clutch adapter having means extending inwardly thereof by which to engage the end cap such that a rotational force applied to said clutch adapter is imparted to the end cap to cause the end cap to be rotated into tightened engagement against the screw threaded end of said neck of said fluid reservoir, said clutch adapter being adapted to rotate around the end cap once the end cap is rotated into tightened engagement against said neck to prevent an over-tightening of the end cap against said neck in response to a continued rotation of said clutch adapter;

a hollow head surrounding said clutch adapter and affixed thereto, such that a rotational force applied to said hollow head is imparted to the end cap by way of said clutch adapter so as to cause the end cap to be rotated into tightened engagement against the screw threaded end of said neck of said fluid reservoir; and a hollow outer body having first and second openings formed therein and surrounding said fluid reservoir, said hollow head being rotatable relative to said hollow outer body, said hollow outer body and said fluid reservoir being flexible so that a compressive force applied to said hollow outer body is transferred to said fluid reservoir to compress said fluid reservoir, said flexible fluid reservoir being compressed and pushed through said first opening in said hollow outer body so as to be surrounded by said hollow outer body such that the neck of said fluid reservoir projects outwardly from said hollow outer body via said second opening formed therein.

2. The combination recited in claim 1, wherein said clutch adapter has a cylindrical body and an annular ledge at the interior of said cylindrical body, the end cap being received within said cylindrical body and seated upon said annular ledge.

3. The combination recited in claim 2, wherein said cylindrical body has at least one longitudinally extending slot formed therein by which to permit said cylindrical body to flex when the end cap is received therewithin.

4. The combination recited in claim 1, wherein said means extending inwardly of said clutch adapter by which to engage the end cap is at least one spline.

5. The combination recited in claim 1, wherein said means extending inwardly of said clutch adapter by which to engage the end cap is a series of splines that are arranged in spaced, parallel alignment with one another around the periphery of said clutch adapter.

6. The combination recited in claim 1, further comprising means by which to prevent a rotation of said fluid reservoir relative to said outer body when said head is rotated so as to cause the end cap to be rotated into tightened engagement against the screw threaded end of said neck of said fluid reservoir.

7. The combination recited in claim 6, wherein said means to prevent the rotation of said fluid reservoir relative to said outer body includes a keyway formed in said outer body and a key projecting outwardly from said fluid reservoir for receipt within said keyway.

8. A combination, comprising:

a fluid reservoir having a key projecting therefrom and an open neck extending outwardly therefrom, said neck having a screw threaded end at which to receive a correspondingly screw threaded end cap so as to close said neck; and a hollow clutch adapter surrounding the end cap, said clutch adapter engaging the end cap such that a rotational force applied to said clutch adapter is imparted to the end cap to cause the end cap to be rotated into tightened engagement against the screw threaded end of said neck of said fluid reservoir, a hollow upper body surrounding said clutch adapter and affixed thereto, such that a rotational force applied to said upper body is imparted to the end cap by way of said clutch adapter to cause the end cap to be rotated into tightened engagement against the screw threaded end of said neck of said fluid reservoir, and a hollow lower body surrounding said fluid reservoir, said hollow lower body having a first opening therein and a keyway formed in said first opening, said upper body being rotatable relative to said lower body so as to cause the end cap to be rotated into tightened engagement against the screw threaded end of said neck of said fluid reservoir, and the key projecting from said fluid reservoir being received by the keyway of said first opening to prevent a rotation of said fluid reservoir relative to said lower body when said upper body is being rotated.

9. The combination recited in claim 8, wherein said lower body also has a second opening formed therein, said fluid reservoir being manufactured from a soft plastic material so that said fluid reservoir may be pushed through said first opening to be surrounded by said lower body, said neck of said fluid reservoir projecting outwardly from said lower body via said second opening.

10. The combination recited in claim 9, wherein said fluid reservoir is manufactured from polypropelene and said lower body is manufactured from PVC.

* * * * *